US009583056B2

(12) United States Patent
Pai et al.

(10) Patent No.: US 9,583,056 B2
(45) Date of Patent: Feb. 28, 2017

(54) PIXEL STRUCTURE AND DRIVING METHOD FOR PIXEL

(71) Applicant: Au Optronics Corporation, Hsinchu (TW)

(72) Inventors: Tsung-Wei Pai, New Taipei (TW); Heng-Yi Tseng, Taipei (TW); Yu-Ching Wu, Hsinchu County (TW); Wen-Hao Hsu, Hsinchu County (TW); Tsung-Hsien Lin, Tainan (TW); Cheng-Chang Li, Kaohsiung (TW)

(73) Assignee: Au Optronics Corporation, Hsinchu (TW)

( * ) Notice: Subject to any disclaimer, the term of this patent is extended or adjusted under 35 U.S.C. 154(b) by 129 days.

(21) Appl. No.: 14/547,145

(22) Filed: Nov. 19, 2014

(65) Prior Publication Data

US 2015/0279302 A1 Oct. 1, 2015

(30) Foreign Application Priority Data

Mar. 27, 2014 (TW) ..... 103111519 A

(51) Int. Cl.
*G09G 3/36* (2006.01)

(52) U.S. Cl.
CPC ..... *G09G 3/3629* (2013.01); *G09G 3/3614* (2013.01); *G09G 2310/061* (2013.01)

(58) Field of Classification Search
None
See application file for complete search history.

(56) References Cited

U.S. PATENT DOCUMENTS

| | | | | |
|---|---|---|---|---|
| 7,369,204 | B1 | 5/2008 | Choi et al. | |
| 8,377,331 | B2 | 2/2013 | Gauza et al. | |
| 8,830,432 | B2 | 9/2014 | Tsai et al. | |
| 2003/0080933 | A1 * | 5/2003 | Kondoh ..... | G09G 3/3629 345/96 |
| 2004/0263749 | A1 | 12/2004 | Jeong et al. | |

(Continued)

FOREIGN PATENT DOCUMENTS

| | | |
|---|---|---|
| CN | 101726953 | 6/2010 |
| JP | 2001330854 | 11/2001 |

(Continued)

*Primary Examiner* — Ryan A Lubit
(74) *Attorney, Agent, or Firm* — Jianq Chyun IP Office

(57) ABSTRACT

A pixel structure including a first electrode layer, a second electrode layer and a liquid crystal layer is provided. The first electrode layer includes a plurality of first electrodes and a plurality of second electrodes, wherein the first electrodes are used for receiving a first driving voltage, and the second electrodes are used for receiving a second driving voltage. The second electrode layer includes a plurality of third electrodes and a plurality of fourth electrodes, wherein the third electrodes are used for receiving a third driving voltage and the fourth electrodes are used for receiving a fourth driving voltage. The liquid crystal layer is disposed between the first electrode layer and the second electrode layer. The first electrodes and the second electrodes are alternately disposed along a first direction parallel to the liquid crystal layer, and the third electrodes and the fourth electrodes are alternately disposed along the first direction.

14 Claims, 5 Drawing Sheets

(56) References Cited

U.S. PATENT DOCUMENTS

| | | | | |
|---|---|---|---|---|
| 2005/0001807 | A1* | 1/2005 | Lee | G02F 1/134363 345/92 |
| 2008/0129901 | A1* | 6/2008 | You | G02F 1/13718 349/33 |
| 2010/0079360 | A1* | 4/2010 | McLaughlin | A61B 5/7445 345/76 |
| 2010/0245224 | A1* | 9/2010 | Xu | G09G 3/3655 345/98 |
| 2011/0075074 | A1* | 3/2011 | Gauza | C09K 19/0275 349/96 |
| 2012/0032992 | A1* | 2/2012 | Lim | G09G 3/3446 345/690 |
| 2012/0327346 | A1 | 12/2012 | Tsai et al. | |
| 2014/0009454 | A1* | 1/2014 | Lee | G09G 3/36 345/211 |
| 2014/0009459 | A1* | 1/2014 | Nakata | G09G 3/3688 345/212 |

FOREIGN PATENT DOCUMENTS

| | | |
|---|---|---|
| TW | 201124508 | 7/2011 |
| TW | 201300910 | 1/2013 |

* cited by examiner

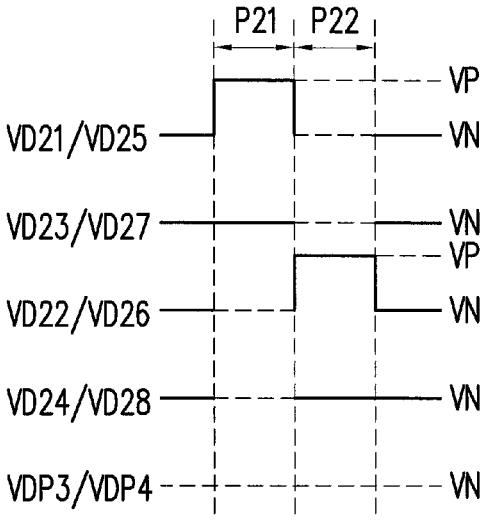

FIG. 2C

In a first liquid crystal driving period, setting the polarity of the first driving voltage to be different from the polarity of the third driving voltage, setting the polarity of the fifth driving voltage to be different from the polarity of the seventh driving voltage, while the second driving voltage and the fourth driving voltage are not supplied to the second electrode and the fourth electrode, and the sixth driving voltage and the eighth driving voltage are not supplied to the sixth electrode and the eighth electrode. ~S210

In a second liquid crystal driving period, setting the polarity of the second driving voltage to be different from the polarity of the fourth driving voltage, setting the polarity of the sixth driving voltage to be different from the polarity of the eighth driving voltage, while the first driving voltage and the third driving voltage are not supplied to the first electrode and the third electrode, and the fifth driving voltage and the seven driving voltage are not supplied to the fifth electrode and the seventh electrode. ~S220

In a liquid crystal resetting period, setting the polarities of the first driving voltage, the second driving voltage, the third driving voltage, and the fourth driving voltage to be identical, setting the polarities of the fifth driving voltage, the sixth driving voltage, the seventh driving voltage, and the eighth driving voltage to be identical, and setting the polarity of the first driving voltage to be different from the polarity of the fifth driving voltage. ~S230

FIG. 2D

PIXEL STRUCTURE AND DRIVING METHOD FOR PIXEL

CROSS-REFERENCE TO RELATED APPLICATION

This application claims the priority benefit of Taiwan application serial no. 103111519, filed on Mar. 27, 2014 . The entirety of the above-mentioned patent application is hereby incorporated by reference herein and made a part of this specification.

BACKGROUND OF THE INVENTION

Field of the Invention

The invention relates to a pixel structure, and more particularly to a liquid crystal pixel structure.

Description of Related Art

With the advancement of semiconductor devices and display apparatuses, multimedia techniques have become highly developed. Among the display devices, thin film transistor liquid crystal display having superior characteristics of high definition, great space utilization, low power consumption, and non-radiation have gradually become mainstream products in the market. Generally speaking, the thin film transistor liquid crystal display panel mainly consists of a thin film transistor array substrate, a color filter substrate, and a liquid crystal layer sandwiched between the two substrates. Since liquid crystal is a device for driving an electric field, the distribution of the electrodes at both sides of the liquid crystal layer will have influence on how efficient the liquid crystal of the liquid crystal layer is used; moreover, the display effect of the display panel will also be affected depending on how efficient the liquid crystal is used. In view of the foregoing, it is an issue to the design of a pixel structure as to how the electrodes at both sides of the liquid crystal layer are arranged to make the liquid crystal to be used efficiently.

SUMMARY OF THE INVENTION

The invention provides a pixel structure which may reduce the driving voltage applied to an electrode and improve use efficiency of a liquid crystal layer.

In the invention, the pixel structure includes a first electrode layer, a second electrode layer, and a liquid crystal layer. The first electrode layer has a plurality of first electrodes and a plurality of second electrodes, wherein the first electrodes are electrically coupled to one another and configured to receive a first driving voltage. The second electrodes are electrically coupled to one another and configured to receive a second driving voltage, and the first driving voltage is different from the second driving voltage. The second electrode layer has a plurality of third electrodes and a plurality of fourth electrodes, wherein the third electrodes are electrically coupled to one another and configured to receive a third driving voltage. The fourth electrodes are electrically coupled to one another and configured to receive a fourth driving voltage, and the third driving voltage is different from the fourth driving voltage. A liquid crystal layer is disposed between the first electrode layer and the second electrode layer, wherein the first electrodes and the second electrodes are alternately disposed along a first direction parallel to the liquid crystal layer, and the first electrodes are not adjacent to one another. The third electrodes and the fourth electrodes are alternately disposed along the first direction, and the third electrodes are not adjacent to one another.

The invention provides a driving method for a pixel, wherein the pixel has a first electrode, a second electrode, a third electrode, and a fourth electrode for driving a liquid crystal layer and respectively receive a first driving voltage, a second driving voltage, a third driving voltage, and a fourth driving voltage, and the first electrode, the second electrode, the third electrode, and the fourth electrode are sequentially adjacent to one another. The driving method includes the following steps. In a first liquid crystal driving period, a polarity of the first driving voltage is set to be different from a polarity of the third driving voltage, while the second driving voltage and the fourth driving voltage are not supplied to the second electrode and the fourth electrode. In a second liquid crystal driving period, a polarity of the second driving voltage is set to be different from a polarity of the fourth driving voltage, while the first driving voltage and the third driving voltage are not supplied to the first electrode and the third electrode. In a liquid crystal resetting period, polarities of the first driving voltage, the second driving voltage, the third driving voltage and the fourth driving voltage are set to be all the same.

Based on the above, in the pixel structure described in the embodiments of the invention, in the same electrode layer, the polarities of the driving voltage received by each electrode are not completely the same, and therefore each electrode layer per se may form an electric field to drive the liquid crystal layer so that the electric field driving effect is not affected by the thickness of the liquid crystal layer. Accordingly, the driving voltage applied to the electrodes may be reduced and the use efficiency of the liquid crystal layer may be improved.

In order to make the aforementioned features and advantages of the invention more comprehensible, embodiments accompanying figures are described in detail below.

BRIEF DESCRIPTION OF THE DRAWINGS

FIGS. 2A-2C are driving schematic views illustrating a pixel structure according to another embodiment of the invention.

FIG. 2D is a flow chart illustrating a driving method for a pixel structure according to another embodiment of the invention.

DESCRIPTION OF EMBODIMENTS

Figure 1A:
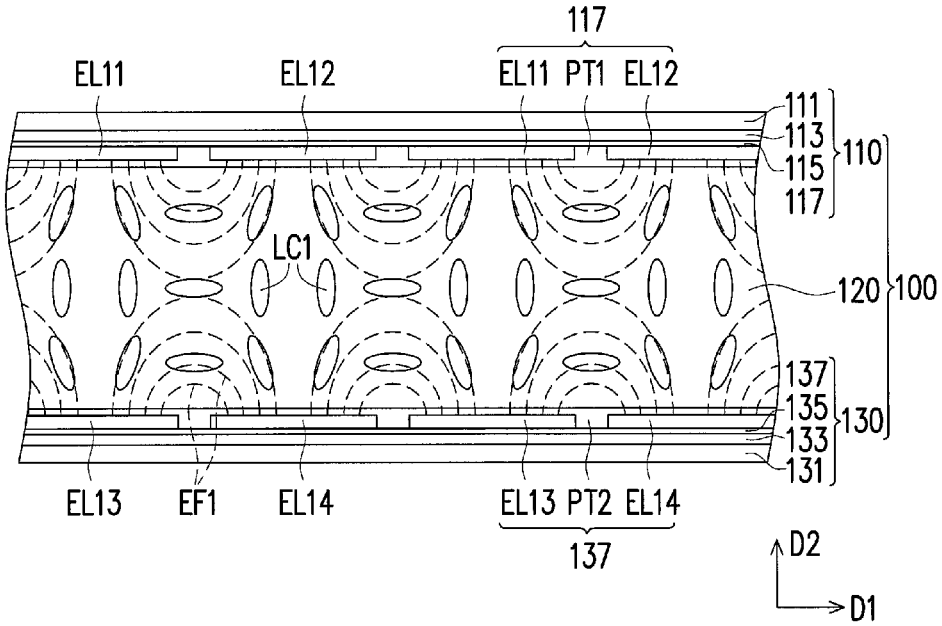
FIGS. 1A-1D are driving schematic views illustrating a pixel structure according to an embodiment of the invention.

FIGS. 1A-1D are driving schematic views illustrating a pixel structure according to an embodiment of the invention. Please refer to FIG. 1A. In the embodiment, a pixel structure 100 includes an upper substrate 110, a liquid crystal layer 120, and a lower substrate 130, wherein the liquid crystal layer 120 is disposed between the upper substrate 110 and the lower substrate 130; that is, the liquid crystal layer 120 is disposed between an electrode layer 117 and an electrode layer 137. The liquid crystal layer 120 includes a plurality of liquid crystal molecules. The liquid crystal molecules may be, for example, bistable liquid crystal molecules such as cholesteric liquid crystal molecules, and the cholesteric liquid crystal molecules are, for example, liquid crystal molecules having a polymer stabilized cholesteric liquid crystal structure. Meanwhile, the upper substrate 110 and the lower substrate 130 may be a thin film transistor array substrate and a color filter substrate respectively, which should not be construed as a limitation to the invention.

The upper substrate 110 sequentially includes a substrate 111, an upper insulating layer 115, and an upper electrode layer 117, and the upper electrode layer 117 sequentially includes a plurality of electrodes EL11 (two electrodes are shown for description) and a plurality of electrodes EL12 (two electrodes are shown for description). In addition, the upper electrode layer 117 may further include a protecting layer PT1, an upper resetting electrode 113, wherein the coverage of the upper resetting electrode 113 includes the coverage of the electrodes EL11 and EL12. Specifically, the upper resetting electrode 113 covers a plurality of electrodes EL11 and EL12. Moreover, the electrodes EL11 and EL12 are alternately disposed along a first direction D1 parallel to the liquid crystal layer 120; that is, the electrodes EL11 are not adjacent to one another, and the electrodes EL12 are not adjacent to one another. Each electrode EL11 is adjacent to two electrodes EL12, and each electrode EL12 is adjacent to two electrodes EL11.

The lower substrate 130 sequentially includes a substrate 131, a lower insulating layer 135, and a lower electrode layer 137; the lower electrode layer 137 sequentially includes a plurality of electrodes EL13 (two electrodes are shown for description) and a plurality of electrodes EL14 (two electrodes are shown for description). In addition, the lower electrode layer 137 may further include a protecting layer PT2, a lower resetting electrode 133, wherein the coverage of the lower resetting electrode 133 includes the coverage of the electrodes EL13 and EL14. Specifically, the lower resetting electrode 133 covers a plurality of electrodes EL13 and EL14. Meanwhile, the electrodes EL13 and EL14 are alternately disposed along the first direction D1 parallel to the liquid crystal layer 120; that is, the electrodes EL13 are not adjacent to one another, and the electrodes EL14 are not adjacent to one another. Each electrode EL13 is adjacent to two electrodes EL14, and each electrode EL14 is adjacent to two electrodes EL13.

In the embodiment, take a second direction D2 perpendicular to the liquid crystal layer 120 as an example; the electrodes EL11 and the electrodes EL13 are oppositely disposed, that is, the disposing position of the electrodes EL11 in the first direction D1 is the same as the disposing position of the electrodes EL13 in the first direction D1. The electrodes EL12 and the electrodes EL14 are oppositely disposed, that is, the disposing position of the electrodes EL12 in the first direction D1 is the same as the disposing position of the electrodes EL14 in the first direction D1. The above descriptions serve as an example only, which should not be construed as a limitation to the invention.

Figure 1B:
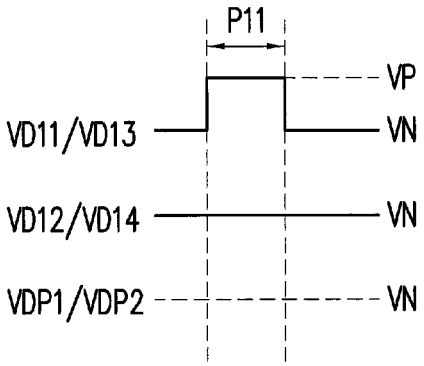
Figure 1C:
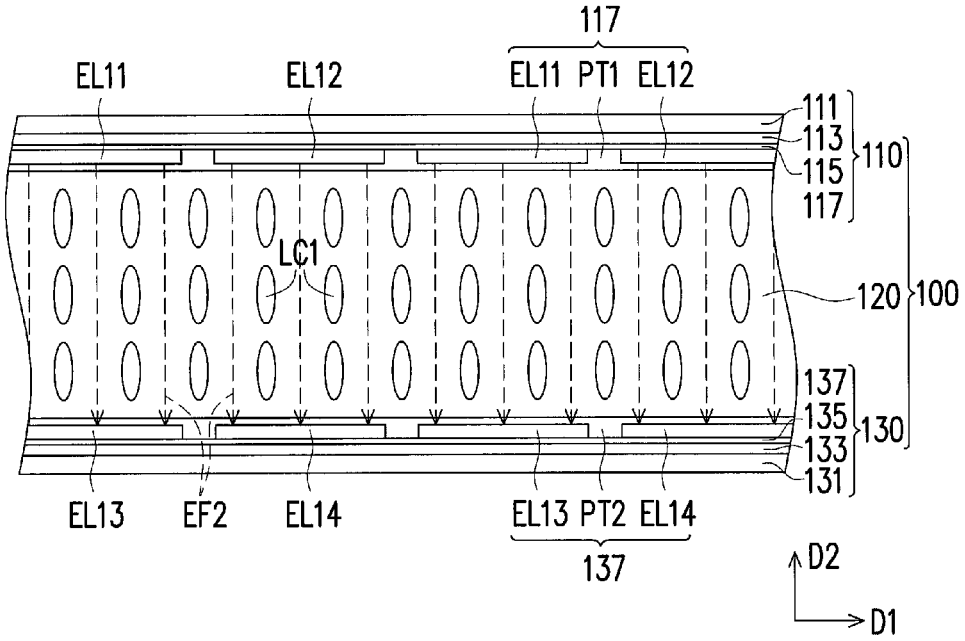
Figure 1D:
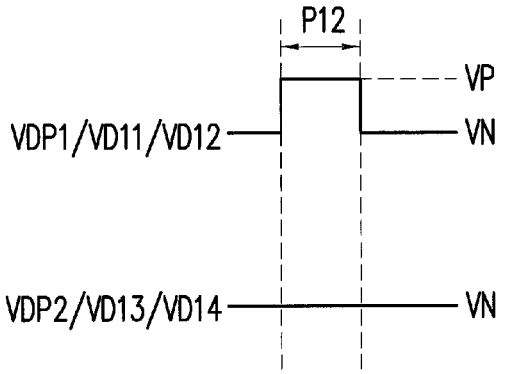

Please refer to FIGS. 1A and 1B, in which identical or similar devices are denoted by the same or similar reference numerals. In the embodiment, a driving voltage VD11 is applied to the electrodes EL11; that is, the electrodes EL11 are electrically coupled to one another. A driving voltage VD12 is applied to the electrodes EL12; that is, the electrodes EL12 are electrically coupled to one another. A driving voltage VD13 is applied to the electrodes EL13; that is, the electrodes EL13 are electrically coupled to one another. A driving voltage VD14 is applied to the electrodes EL14; that is, the electrodes EL14 are electrically coupled to one another. A driving voltage VDP1 is applied to the upper resetting electrode 113; a driving voltage VDP2 is applied to the lower resetting electrode 133, wherein the driving voltages VD11-VD14 and VDP1 and VDP2 are different voltage signals.

In a liquid crystal driving period P11, the driving voltages VD11 and VD13 are high level voltages such as a positive voltage VP. The driving voltages VD12 and VD14 are low level voltages such as a negative voltage VN. That is, the polarities of the driving voltages VD11 and VD13 are different from the polarities of the driving voltages VD12 and VD14. The polarity of the driving voltage VD11 is the same as the polarity of the driving voltage VD13; the polarity of the driving voltage VD12 is the same as the polarity of the driving voltage VD14. Moreover, the driving voltages VDP1 and VDP2 are not applied to the upper resetting electrode 113 and the lower resetting electrode 133 (which are shown in dashed lines). At that time, the electric field formed by the electrodes EL11-EL14 may be shown as an electric field EF1, and a portion of liquid crystal LC1 of the liquid crystal layer 120 rotates due to the influence of the electric field EF1.

In the embodiment, the electric field EF1 within the liquid crystal layer 120 is formed mainly due to the influence caused by the voltage level of the adjacent electrodes among the electrodes EL11-EL14; that is, the top of the liquid crystal layer 120 is driven by the electrodes EL11 and EL12, and the bottom of the liquid crystal layer 120 is driven by the electrodes EL13 and EL14 instead of the oppositely disposed electrodes. Therefore, the driving effect of the electric field EF1 is not affected by the thickness of the liquid crystal layer 120 so that the driving voltages VD11-VD14 applied to the electrodes EL11-EL14 may be reduced, and the use efficiency of the liquid crystal layer 120 may be improved.

Please refer to FIGS. 1A-1D, in which identical or similar devices are denoted by the same or similar reference numerals. For example, in the embodiment for the driving method shown in FIG. 1D, the driving voltage VD11 is applied to the electrodes EL11; the driving voltage VD12 is applied to the electrodes EL12; the driving voltage VD13 is applied to the electrodes EL13; the driving voltage VD14 is applied to the electrodes EL14; the driving electrode VDP1 is applied to the upper resetting electrode 113; the driving voltage VDP2 is applied to the lower resetting electrode 133.

In a liquid crystal resetting period P12, the driving voltages VDP1, VD11 and VD12 are set to be high level voltages such as a positive voltage VP; that is, the polarities of the driving voltages VDP1, VD11 and VD12 are identical to one another. Besides, the driving voltages VDP2, VD13 and VD14 are set to be low level voltages such as a negative voltage VN; that is, the polarities of the driving voltages VDP2, VD13 and VD14 are identical to one another. At that time, the electric field formed by the electrodes EL11-EL14 may be shown as an electric field EF2 to reset the rotating angles of each liquid crystal LC1.

In the embodiment, the upper resetting electrode 113 and the lower resetting electrode 133 enhance the restoring speed of the liquid crystal LC1. In the circumstance where the restoring speed of the liquid crystal LC1 is soon enough, the upper resetting electrode 113 and the lower resetting electrode 133 may be selectively omitted with no impact on the operation of the liquid crystal layer 120, which may be modified by persons of ordinary skill in the art at their discretion.

Figure 1E:
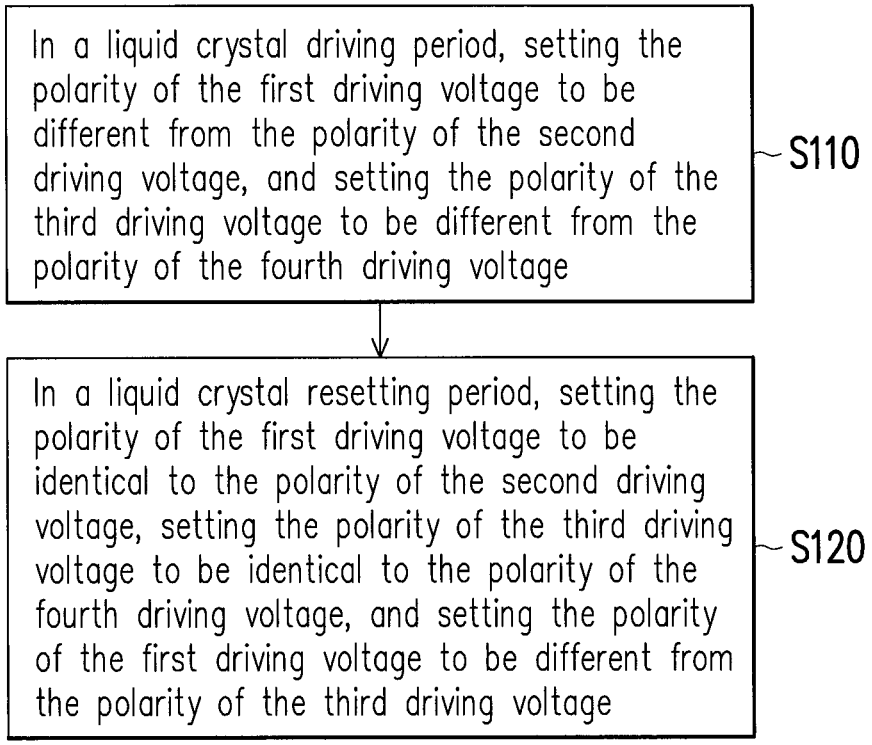
FIG. 1E is a flow chart illustrating a driving method for a pixel structure according to an embodiment of the invention.

FIG. 1E is a flow chart illustrating a driving method for a pixel structure according to an embodiment of the invention. Please refer to FIG. 1E. In the embodiment, the driving method is adaptable for a pixel structure having a first electrode, a second electrode, a third electrode, a fourth electrode and a liquid crystal layer. Also, the first electrode, the second electrode, the third electrode, and the fourth electrode respectively receive a first driving voltage, a second driving voltage, a third driving voltage, and a fourth driving voltage to drive the liquid crystal layer. Take the liquid crystal layer as a base; the first electrode and the second electrode are disposed to be adjacent to each other (as the electrodes EL11 and EL12 shown in FIG. 1A); the third electrode and the fourth electrode are disposed to be adjacent to each other (as the electrodes EL13 and EL14 shown in FIG. 1A); the first electrode and the third electrode are oppositely disposed (as the electrodes EL11 and EL13 shown in FIG. 1A); the second electrode and the fourth electrode are oppositely disposed (as the electrodes EL12 and EL14 shown in FIG. 1A).

In the embodiment, the driving method includes the following steps. In the liquid crystal driving period, the polarity of the first driving voltage is set to be different from the polarity of the second driving voltage, and the polarity of the third driving voltage is set to be different from the polarity of the fourth driving voltage (step S110). In the liquid crystal resetting period, the polarity of the first driving voltage is set to be the same as the polarity of the second driving voltage; the polarity of the third driving voltage is set to be the same as the polarity of the fourth driving voltage; and the polarity of the first driving voltage is set to be different from the polarity of the third driving voltage (step S120). The sequence of steps S110 and S120 is described as an example only, which should not be construed as a limitation to the invention. Please refer to FIGS. 1A-1D for the details of steps S110 and S120, no further descriptions are incorporated herein.

Figure 2A:
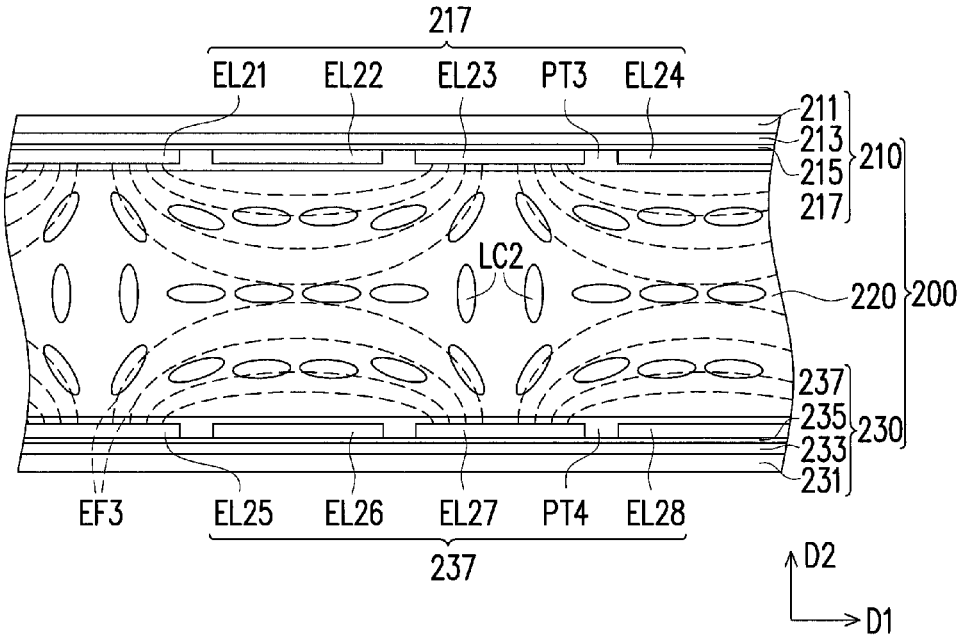
Figure 2B:
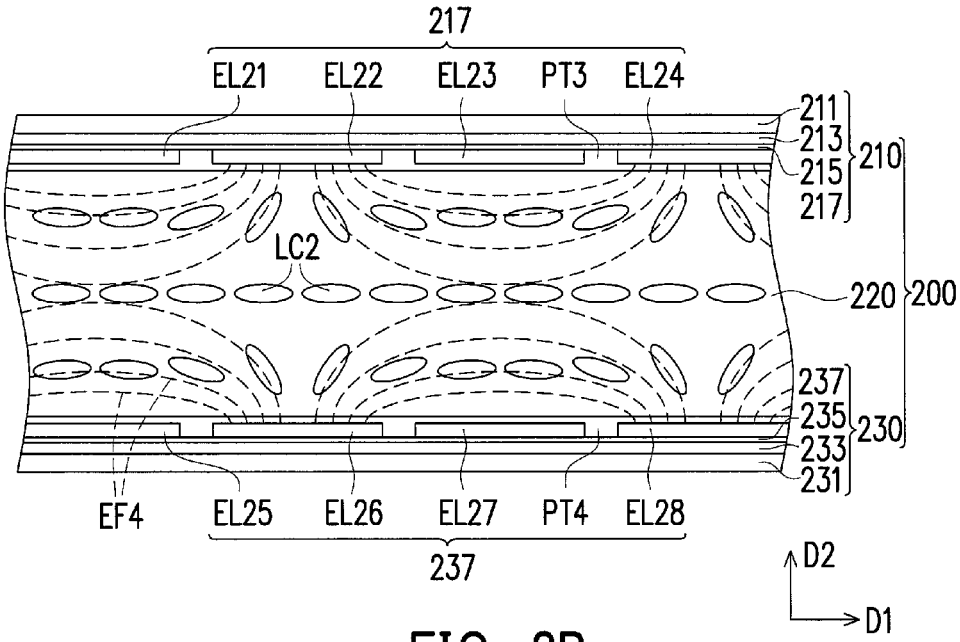

FIGS. 2A-2C are driving schematic views illustrating a pixel structure according to another embodiment of the invention. Please refer to FIG. 2A. In the embodiment, a pixel structure 200 includes an upper substrate 210, a liquid crystal layer 220, and a lower substrate 230, wherein the liquid crystal layer 220 is disposed between the upper substrate 210 and the lower substrate 230; that is, the liquid crystal layer 220 is disposed between the electrode layers 217 and 237. The liquid crystal layer 220 includes a plurality of liquid crystal molecules, which may be, for example, bistable liquid crystal molecules such as cholesteric liquid crystal molecules; the cholesteric liquid crystal molecules are, for example, liquid crystal molecules having a polymer stabilized cholesteric liquid crystal structure. Moreover, the upper substrate 210 and the lower substrate 230 may be a thin film transistor array substrate and a color filter substrate respectively, which should not be construed as a limitation to the invention.

The upper substrate 210 sequentially includes a substrate 211, an upper insulating layer 215, and an upper electrode layer 217. The upper electrode layer 217 sequentially includes a plurality of electrodes EL21 (one electrode is shown for description), a plurality of electrodes EL22 (one is shown for description), a plurality of electrodes EL23 (one is shown for description), and a plurality of electrodes EL24 (one is shown for description). In addition, the upper electrode layer 217 may further include an upper resetting electrode 213 and a protecting layer PT3, wherein the coverage of the upper resetting electrode 213 includes the coverage of electrodes EL21-EL24. Specifically, the upper resetting electrode 213 covers a plurality of electrodes EL21-EL44. Furthermore, the electrodes EL21-EL24 are alternately disposed along a first direction Dl parallel to the liquid crystal layer 220. In other words, the electrodes EL21 are not adjacent to one another; the electrodes EL22 are not adjacent to one another; the electrodes EL23 are not adjacent to one another; the electrodes EL24 are not adjacent to one another. Each electrode EL22 is adjacent to the electrodes EL21 and EL23; each electrode EL23 is adjacent to the electrodes EL22 and EL24.

The lower substrate 230 sequentially includes a substrate 231, a lower resetting electrode 233, a lower insulating layer 235, and a lower electrode layer 237. The lower electrode layer 237 sequentially includes a plurality of electrodes EL25 (one is shown for description), a plurality of electrodes EL26 (one is shown for description), a plurality of electrodes EL27 (one is shown for description), and a plurality of electrodes EL28 (one is shown for description). In addition, the lower electrode layer 237 may further include the lower resetting electrode 233 and a protecting layer PT4, wherein the coverage of the lower resetting electrode 233 includes the coverage of electrodes EL25-EL28. Specifically, the lower resetting electrode 233 covers a plurality of electrodes EL25-EL28, and the electrodes EL25-EL28 are alternately disposed along the first direction D1 parallel to the liquid crystal layer 220. That is to say, the electrodes EL25 are not adjacent to one another; the electrodes EL26 are not adjacent to one another; the electrodes EL27 are not adjacent to one another; the electrodes EL28 are not adjacent to one another. Each electrode EL26 is adjacent to the electrodes EL25 and EL27; each electrode EL27 is adjacent to the electrodes EL26 and EL28.

In the embodiment, take a second direction D2 perpendicular to the liquid crystal layer 220 as an example; the electrodes EL21 and EL25 are oppositely disposed, that is, the disposing position of the electrodes EL21 in the first direction D1 is the same as the disposing position of the electrodes EL25 in the first direction D1. The electrodes EL22 and EL26 are oppositely disposed, that is, the disposing position of the electrodes EL22 in the first direction D1 is the same as the disposing position of the electrodes EL26 in the first direction D1. The electrodes EL23 and the electrodes EL27 are oppositely disposed, that is, the disposing position of the electrodes EL23 in the first direction D1 is the same as the disposing position of the electrodes EL27 in the first direction D1. The electrodes EL24 and EL28 are oppositely disposed, that is, the disposing position of the electrodes EL24 in the first direction D1 is the same as the disposing position of the electrodes EL28 in the first direction D1. The above descriptions serve as an example only, which should not be construed as a limitation to the invention.

Please refer to FIGS. 2A-2C, in which identical or similar devices are denoted by the same or similar reference numerals. In the embodiment, a driving voltage VD21 is applied to the electrodes EL21; that is, the electrodes EL21 are electrically coupled to one another. A driving voltage VD22 is applied to the electrodes EL22; that is, the electrodes EL22 are electrically coupled to one another. A driving voltage VD23 is applied to the electrodes EL23; that is, the electrodes EL23 are electrically coupled to one another. A driving voltage VD24 is applied to the electrodes EL24; that is, the electrodes EL24 are electrically coupled to one another. A driving voltage VD25 is applied to the electrodes EL25; that is, the electrodes EL25 are electrically coupled to one another. A driving voltage VD26 is applied to the electrodes EL26; that is, the electrodes EL26 are electrically coupled to one another. A driving voltage VD27 is applied to the electrode EL27; that is, the electrodes EL27 are electrically coupled to one another. A driving voltage VD28 is applied to the electrode EL28; that is, the electrodes EL28 are electrically coupled to one another. A driving voltage VDP3 is applied to the upper resetting electrode 213; the driving voltage VDP4 is applied to the lower resetting electrode 233, wherein the driving voltages VD21-VD28, VDP3 and VDP4 are different voltage signals.

In a first liquid crystal driving period P21, the driving voltages VD21 and VD25 are high level voltages such as a positive voltage VP. The driving voltages VD23 and VD27 are low level voltages such as a negative voltage VN. That is, the polarities of the driving voltages VD21 and VD25 are different from the polarities of the driving voltages VD23 and VD27. The polarities of the driving voltages VD21 and VD25 are identical. The polarities of the driving voltages VD23 and VD27 are identical. Besides, the driving voltages VD22, VD24, VD26, and VD28 are not applied to the electrodes EL22, EL24, EL26, and EL28 (which are shown in dashed lines); the driving voltages VDP3 and VDP4 are not applied to the upper resetting electrode 213 and the lower resetting electrode 233 (which are shown in dashed lines). At that time, the electric field formed by the electrodes EL21, EL23, EL25, EL27 may be shown as an electric field EF3, and a portion of liquid crystal LC2 of the liquid crystal layer 220 rotates due to the influence of the electric field EF3.

Furthermore, in a second liquid crystal driving period P22, the driving voltages VD22 and VD26 are high level voltages such as a positive voltage VP. The driving voltages VD24 and VD28 are low level voltages such as a negative voltage VN. That is, the polarities of the driving voltages VD22 and VD26 are different from the polarities of the driving voltages VD24 and VD28; the polarities of the driving voltages VD22 and VD26 are identical; the polarities of the driving voltages VD24 and VD28 are identical. Meanwhile, the driving voltages VD21, VD23, VD25, and VD27 are not applied to the electrodes EL21, EL23, EL25, and EL27 (which are shown in dashed lines). The driving voltages VDP3 and VDP4 are not applied to the upper resetting electrode 213 and the lower resetting electrode 233 (which are shown in dashed lines). At that time, the electric field formed by the electrodes EL22, EL24, EL26, and EL28 may be shown as an electric field EF4, and a portion of liquid crystal LC3 of the liquid crystal layer 220 rotates due to the influence of the electric field EF4.

Comparing FIG. 1A with FIG. 2B, the portion of the liquid crystal LC1 in FIG. 1A does not rotate (i.e. the portion of liquid crystal LC1 is not driven), whereas each liquid crystal LC2 in FIG. 2B rotates (i.e. every liquid crystal LC2 is driven). Thus, the use efficiency of the pixel structure 200 is higher than that of the pixel structure 100; that is, the display effect of the pixel structure 200 is better than that of the pixel structure 100.

Then, in the liquid crystal resetting period, the driving voltages VDP3 and VD21-VD24 may be set to be a high level voltage such as a positive voltage VP. That is, the polarities of the driving voltages VDP3 and VD21-VD24 may be identical. Furthermore, the driving voltages VDP4 and VD25-VD28 may be set to be a low level voltage such as a negative voltage VN. That is, the polarities of the driving voltages VDP4 and VD25-VD28 may be identical. At that time, the electric field formed by the electrodes EL21-EL28 is similar to the electric field EF2 in FIG. 1C. Therefore, the rotating angles of each liquid crystal LC2 may be reset.

FIG. 2D is a flow chart illustrating a driving method for a pixel structure according to another embodiment of the invention. Please refer to FIG. 2D. In the embodiment, the driving method is adaptable for a pixel structure having a first electrode, a second electrode, a third electrode, a fourth electrode, a fifth electrode, a sixth electrode, a seventh electrode, an eighth electrode, and a liquid crystal layer. Meanwhile, the first electrode, the second electrode, the third electrode, the fourth electrode, the fifth electrode, the sixth electrode, the seventh electrode, and the eighth electrode respectively receive a first driving voltage, a second driving voltage, a third driving voltage, a fourth driving voltage, a fifth driving voltage, a sixth driving voltage, a seventh driving voltage, and an eighth driving voltage to drive the liquid crystal layer.

Take the liquid crystal layer as a base. The second electrode is adjacent to the first electrode and the third electrode (as the electrodes EL21-EL23 shown in FIG. 2A); the third electrode is adjacent to the second electrode and the fourth electrode (as the electrodes EL22-EL24 shown in FIG. 2A). That is to say, the first electrode, the second electrode, the third electrode, and the fourth electrode are sequentially adjacent to one another. Also, the sixth electrode is adjacent to the fifth electrode and the seventh electrode (as the electrodes EL25-EL27 shown in FIG. 2A); the seventh electrode is adjacent to the sixth electrode and the eighth electrode (as the electrodes EL26-EL28 shown in FIG. 2A). That is, the fifth electrode, the sixth electrode, the seventh electrode, and the eighth electrode are sequentially adjacent to one another and sequentially opposite to the first electrode, the second electrode, the third electrode, and the fourth electrode.

In the embodiment, the driving method includes the following steps. In the first liquid crystal driving period, the polarity of the first driving voltage is set to be different from the polarity of the third driving voltage. The polarity of the fifth driving voltage is set to be different from the polarity of the seventh driving voltage, while the second driving voltage and the fourth driving voltage are not supplied to the second electrode and the fourth electrode, and the sixth driving voltage and the eighth driving voltage are not supplied to the sixth electrode and the eighth electrode (step S210).

In the second liquid crystal driving period, the polarity of the second driving voltage is set to be different from the polarity of the fourth driving voltage; the polarity of the sixth driving voltage is set to be different from the polarity of the eighth driving voltage, while the first driving voltage and the third driving voltage are not supplied to the first electrode and the third electrode, and the fifth driving voltage and the seventh driving voltage are not supplied to the fifth electrode and the seventh electrode (step S220).

In the liquid crystal resetting period, the polarities of the first driving voltage, the second driving voltage, the third driving voltage, and the fourth driving voltage are set to be identical. The polarities of the fifth driving voltage, the sixth driving voltage, the seventh driving voltage, and the eighth driving voltage are set to be identical. Meanwhile, the polarity of the first driving voltage is set to be different from the polarity of the fifth driving voltage (step S230). The sequence of the above steps 5210, S220, and S230 is described as an example only, which should not be construed as a limitation to the invention. Moreover, please see FIGS. 2A-2C for further details of steps S210, 5220, and 5230; no further descriptions are incorporated herein.

Based on the above, in the pixel structure according to the embodiments of the invention, in the same electrode layer, the polarity of the driving voltage received by each electrode is not completely the same; therefore, each electrode layer per se may form an electric field to drive the liquid crystal layer so that the driving effect of the electric field is not affected by the thickness of the liquid crystal layer. In light of the above, the driving voltage applied to the electrode may be reduced and the use efficiency of the liquid crystal layer may be improved.

It will be apparent to those skilled in the art that various modifications and variations can be made to the structure of the disclosed embodiments without departing from the scope or spirit of the invention. In view of the foregoing, it is intended that the disclosure cover modifications and variations of this specification provided they fall within the scope of the following claims and their equivalents.

What is claimed is:

1. A pixel structure, comprising:

a first electrode layer having a plurality of first electrodes and a plurality of second electrodes, wherein the first electrodes are electrically coupled to one another and configured to receive a first driving voltage, the second electrodes are electrically coupled to one another and configured to receive a second driving voltage, and the first driving voltage is different from the second driving voltage;

a second electrode layer having a plurality of third electrodes and a plurality of fourth electrodes, wherein the third electrodes are electrically coupled to one another and configured to receive a third driving voltage, the fourth electrodes are electrically coupled to one another and configured to receive a fourth driving voltage, and the third driving voltage is different from the fourth driving voltage; and a liquid crystal layer disposed between the first electrode layer and the second electrode layer and comprising a plurality of cholesteric liquid crystal molecules, wherein the first electrodes and the second electrodes are alternately disposed along a first direction parallel to the liquid crystal layer, and the first electrodes are not adjacent to one another, the third electrodes and the fourth electrodes are alternately disposed along the first direction , and the third electrodes are not adjacent to one another, wherein the first electrode layer further comprises a plurality of fifth electrodes and a plurality of sixth electrodes, wherein the fifth electrodes are electrically coupled to one another and configured to receive a fifth driving voltage, the sixth electrodes are electrically coupled to one another and configured to receive a sixth driving voltage, the fifth driving voltage is different from the sixth driving voltage, the first electrodes, the second electrodes, the fifth electrodes, and the sixth electrodes are alternately disposed along the first direction, each of the plurality of fifth electrodes is adjacent to one of the first electrodes and one of the second electrodes, and each of the plurality of the second electrodes is adjacent to one of the fifth electrodes and one of the sixth electrodes, in a first liquid crystal driving period, a polarity of the first driving voltage is different from a polarity of the second driving voltage, and the fifth driving voltage and the sixth driving voltage are not supplied to the fifth electrodes and the sixth electrodes, and in a second liquid crystal driving period, a polarity of the fifth driving voltage is different from a polarity of the sixth driving voltage, and the first driving voltage and the second driving voltage are not supplied to the first electrodes and the second electrodes.

2. The pixel structure according to claim 1, wherein the cholesteric liquid crystal molecules are polymer stabilized cholesteric liquid crystal molecules.

3. The pixel structure according to claim 1, wherein, in a liquid crystal resetting period, the polarity of the first driving voltage is identical to the polarity of the second driving voltage, a polarity of the third driving voltage is identical to a polarity of the fourth driving voltage, and the polarity of the first driving voltage is different from the polarity of the third driving voltage.

4. The pixel structure according to claim 1, wherein the second electrode layer comprises a plurality of seventh electrodes and a plurality of eighth electrodes, wherein the seventh electrodes are electrically coupled to one another and configured to receive a seventh driving voltage, the eighth electrodes are electrically coupled to one another and configured to receive an eighth driving voltage, the seventh driving voltage is different from the eighth driving voltage, the third electrodes, the fourth electrodes, the seventh electrodes, and the eighth electrodes are alternately disposed along the first direction, each of the plurality of seventh electrodes is adjacent to one of the third electrodes and one of the fourth electrodes, each of the plurality of fourth electrodes is adjacent to one of the seventh electrodes and one of the eighth electrodes, in the first liquid crystal driving period, a polarity of the third driving voltage is different from a polarity of the fourth driving voltage, and the seventh driving voltage and the eighth driving voltage are not supplied to the seventh electrodes and the eighth electrodes, and in the second liquid crystal driving period, a polarity of the seventh driving voltage is different from a polarity of the eighth driving voltage, and the third driving voltage and the fourth driving voltage are not supplied to the third electrodes and the fourth electrodes.

5. The pixel structure according to claim 1, wherein, in the first liquid crystal driving period, the polarity of the first driving voltage is identical to a polarity of the third driving voltage, the polarity of the second driving voltage is identical to a polarity of the fourth driving voltage, in the second liquid crystal driving period, the polarity of the fifth driving voltage is identical to a polarity of the seventh driving voltage, the polarity of the sixth driving voltage is identical to a polarity of the eighth driving voltage.

6. The pixel structure according to claim 1, wherein, in a liquid crystal resetting period, the polarities of the first driving voltage, the second driving voltage, the fifth driving voltage and the sixth driving voltage are identical, polarities of the third driving voltage, the fourth driving voltage, the seventh driving voltage, and the eighth driving voltage are identical, the polarity of the first driving voltage is different from the polarity of the third driving voltage.

7. The pixel structure according to claim 1, wherein the first electrodes and the third electrodes are oppositely disposed, the second electrodes and the fourth electrodes are oppositely disposed, the fifth electrodes and the seventh electrodes are oppositely disposed, the sixth electrodes and the eighth electrodes are oppositely disposed.

8. The pixel structure according to claims 1, wherein the first electrode layer further comprises an upper resetting electrode covering the first electrodes and the second electrodes, and the second electrode layer further comprises a lower resetting electrode covering the third electrodes and the fourth electrodes.

9. A driving method for a pixel, the pixel comprising a first electrode, a second electrode, a third electrode, and a fourth electrode for driving a liquid crystal layer and respectively configured to receive a first driving voltage, a second driving voltage, a third driving voltage, and a fourth driving voltage, wherein the first electrode, the second electrode, the third electrode, and the fourth electrode are sequentially adjacent to one another, the driving method comprising:

in a first liquid crystal driving period, setting a polarity of the first driving voltage to be different from a polarity of the third driving voltage, while the second driving voltage and the fourth driving voltage being not supplied to the second electrode and the fourth electrode;

in a second liquid crystal driving period, setting a polarity of the second driving voltage to be different from a polarity of the fourth driving voltage, while the first driving voltage and the third driving voltage being not supplied to the first electrode and the third electrode; and in a liquid crystal resetting period, setting the polarities of the first driving voltage, the second driving voltage, the third driving voltage, and the fourth driving voltage to the identical.

10. The driving method for the pixel according to claim 9, the pixel further having a fifth electrode, a sixth electrode, a seventh electrode, and an eighth electrode for driving the liquid crystal layer and respectively configured to receive a fifth driving voltage, a sixth driving voltage, a seventh driving voltage, and an eighth driving voltage, wherein the first electrode, the second electrode, the third electrode, and the fourth electrode are sequentially opposite to the fifth electrode, the sixth electrode, the seventh electrode, and the eighth electrode, further comprising:

in the first liquid crystal driving period, setting a polarity of the fifth driving voltage to be different from a polarity of the seventh driving voltage, while the sixth driving voltage and the eighth driving voltage being not supplied to the sixth electrode and the eighth electrode;

in the second liquid crystal driving period, setting a polarity of the sixth driving voltage to be different from a polarity of the eighth driving voltage, while the fifth driving voltage and the seventh driving voltage not being supplied to the fifth electrode and the seventh electrode; and in the liquid crystal resetting period, setting the polarities of the fifth driving voltage, the sixth driving voltage, the seventh driving voltage, and the eighth driving voltage to be identical.

11. The driving method for the pixel according to claim 10, further comprising:

in the first liquid crystal driving period, setting the polarity of the first driving voltage to be identical to the polarity of the fifth driving voltage, setting the polarity of the third driving voltage to be identical to the polarity of the seventh driving voltage; and in the second liquid crystal driving period, setting the polarity of the second driving voltage to be identical to the polarity of the sixth driving voltage, setting the polarity of the fourth driving voltage to be identical to the polarity of the eighth driving voltage.

12. A pixel, comprising:

a first electrode, a second electrode, a third electrode, and a fourth electrode for driving a liquid crystal layer and respectively configured to receive a first driving voltage, a second driving voltage, a third driving voltage, and a fourth driving voltage, wherein the first electrode, the second electrode, the third electrode, and the fourth electrode are sequentially adjacent to one another, and wherein in a first liquid crystal driving period, a polarity of the first driving voltage is set to be different from a polarity of the third driving voltage, while the second driving voltage and the fourth driving voltage are not supplied to the second electrode and the fourth electrode;

in a second liquid crystal driving period, a polarity of the second driving voltage is set to be different from a polarity of the fourth driving voltage, while the first driving voltage and the third driving voltage are not supplied to the first electrode and the third electrode; and in a liquid crystal resetting period, the polarities of the first driving voltage, the second driving voltage, the third driving voltage, and the fourth driving voltage are set to be identical.

13. The pixel according to claim 12, further comprising a fifth electrode, a sixth electrode, a seventh electrode, and an eighth electrode for driving the liquid crystal layer and respectively configured to receive a fifth driving voltage, a sixth driving voltage, a seventh driving voltage, and an eighth driving voltage, wherein the first electrode, the second electrode, the third electrode, and the fourth electrode are sequentially opposite to the fifth electrode, the sixth electrode, the seventh electrode, and the eighth electrode, and wherein in the first liquid crystal driving period, a polarity of the fifth driving voltage is set to be different from a polarity of the seventh driving voltage, while the sixth driving voltage and the eighth driving voltage are not supplied to the sixth electrode and the eighth electrode;

in the second liquid crystal driving period, a polarity of the sixth driving voltage is set to be different from a polarity of the eighth driving voltage, while the fifth driving voltage and the seventh driving voltage are not supplied to the fifth electrode and the seventh electrode; and in the liquid crystal resetting period, the polarities of the fifth driving voltage, the sixth driving voltage, the seventh driving voltage, and the eighth driving voltage are set to be identical.

14. The pixel according to claim 13, wherein in the first liquid crystal driving period, the polarity of the first driving voltage is set to be identical to the polarity of the fifth driving voltage, and the polarity of the third driving voltage is set to be identical to the polarity of the seventh driving voltage; and in the second liquid crystal driving period, the polarity of the second driving voltage is set to be identical to the polarity of the sixth driving voltage, and the polarity of the fourth driving voltage is set to be identical to the polarity of the eighth driving voltage.

* * * * *